United States Patent [19]

Demido

[11] 4,047,048

[45] Sept. 6, 1977

[54] MASTER CYLINDER WITH COMBINED RESERVOIR COVER, SEAL AND FLUID LEVEL SENSOR ASSEMBLY

[75] Inventor: Michael Demido, Troy, Ohio

[73] Assignee: General Motors Corporation, Detroit, Mich.

[21] Appl. No.: 675,742

[22] Filed: Apr. 12, 1976

[51] Int. Cl.[2] ..... H01H 35/18

[52] U.S. Cl. ..... 307/118; 220/367; 200/84 R; 340/244 E

[58] Field of Search ..... 220/23, 374, 367, 352, 220/358; 340/59, 244 E, 244 A; 200/84 R, 81.4, 81; 307/118; 73/307, 308

[56] References Cited

U.S. PATENT DOCUMENTS

| | | | |
|---|---|---|---|
| 3,510,836 | 5/1970 | Summerer | 340/59 |
| 3,531,767 | 9/1970 | Klein et al. | 340/244 E |
| 3,593,271 | 7/1971 | Schrader | 200/84 R |
| 3,609,680 | 9/1971 | Belart | 340/59 |
| 3,931,485 | 1/1976 | Spielfiedel et al. | 200/81.4 |
| 3,964,079 | 6/1976 | Katagiri et al. | 340/244 E |

*Primary Examiner*—Robert K. Schaefer

*Assistant Examiner*—Morris Ginsburg

*Attorney, Agent, or Firm*—D. D. McGraw

[57] ABSTRACT

A master cylinder assembly has a stamped steel reservoir and a cover in which a switch, appropriate electrical conduits, and a connector are integrally molded. A fluid level sensor float and rod are arranged to open and close the switch depending upon the level of fluid in the reservoir. A diaphragm seal is assembled to the underside of the cover and has a rod guide provided for the sensor rod. The guide also provides a suitable vent between the fluid chamber of the reservoir and the otherwise sealed space between the diaphragm and the cover. The cover has a peripheral channel receiving a peripheral mounting edge of the diaphragm so that the diaphragm also acts as a seal between the cover and the reservoir housing. The sealing action is primarily radial, between a channel wall and the reservoir housing wall, therefore not requiring the cover to be tightly clamped in place in order to compress a seal. The cover assembly is snapped into place on the reservoir housing. The reservoir also has a plastic inserted baffle dividing the reservoir into a plurality of baffled chambers.

3 Claims, 4 Drawing Figures

MASTER CYLINDER WITH COMBINED RESERVOIR COVER, SEAL AND FLUID LEVEL SENSOR ASSEMBLY

The invention relates to a master cylinder assembly and more particularly to one having a sealed reservoir provided with a fluid level sensor. The sensor mechanism has the switch contacts and electrical connector integrally molded into a snap-on cover. The movable parts of the fluid level sensor are guided by a guide member provided in a section of a diaphragm seal for the reservoir. The diaphragm seal provides a radial sealing arrangement between the cover and the reservoir housing.

IN THE DRAWINGS

Figure 1:
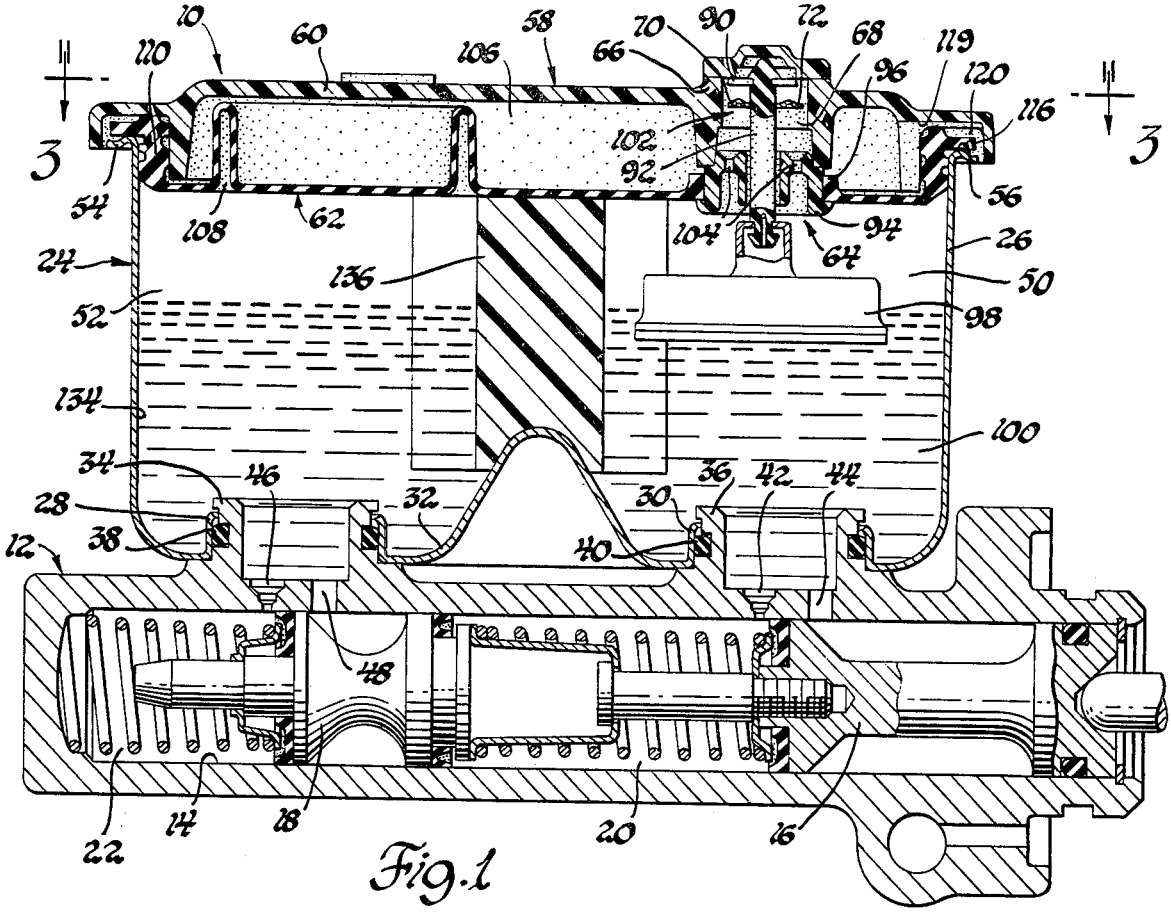
FIG. 1 is a cross-section view of a master cylinder assembly embodying the invention.

The master cylinder assembly 10 includes a master cylinder body 12 having a bore 14 in which the primary and secondary pistons 16 and 18 are reciprocably received. Other associated mechanisms are also illustrated and are typical of a dual master cylinder. The primary piston 16 pressurizes brake fluid in primary chamber 20, and the secondary piston 18 pressurizes brake fluid in the secondary chamber 22, when the master cylinder is actuated. As is well known in the art, these chambers may be connected to separate brake actuating circuits.

The assembly 10 has a reservoir section 24 including a stamped reservoir housing 26. Housing 26 has annular flanges 28 and 30 formed in separate sections of the housing bottom 32 so that the flanges are fitted over bosses 34 and 36 on the cylinder body 12. Seals 38 and 40 respectively seal the connections so that no fluid is lost between the housing 26 and the cylinder body 12. Primary compensation ports 42 and 44 and secondary compensation ports 46 and 48 are respectively provided through bosses 36 and 34 to interconnect the reservoir chamber sections 50 and 52 with bore 14. Housing 26 also has a flange 54 at its upper surface which extends generally outward around the periphery of the housing to provide a continuous upper edge surface 56.

Figure 2:
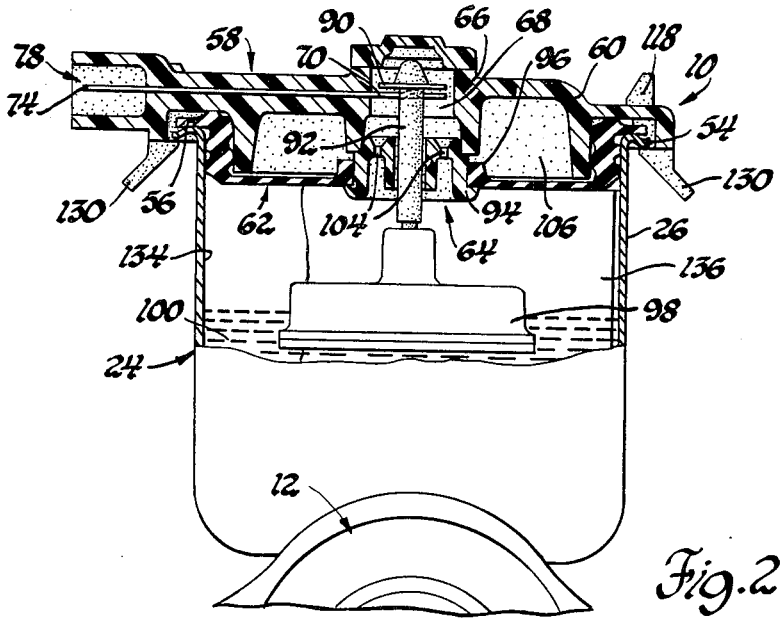
FIG. 2 is a transverse section, with parts broken away, of the master cylinder of FIG. 1, the section being taken in the direction of arrows 2—2 of FIG. 3.

The reservoir section 24 also includes a cover assembly 58. This assembly includes a molded cover 60, a convoluted diaphragm seal 62, and a fluid level sensor mechanism 64. The cover 60 has an integrally formed fluid level sensor mounting hub 66 positioned over one chamber section. In the particular unit illustrated, hub 66 is positioned over reservoir chamber section 50. The hub has a switch chamber 68 containing fixed electrical contacts 70 and 72. As better shown in FIG. 3, contacts 70 and 72 are positioned on either side of chamber 68 and are respectively formed by the ends of electrical conduits 74 and 76. These conduits are molded into cover 60 and terminate at one cover side to form a part of connector 78. The connector is illustrated as being a female connector adapted to receive a male connector formed as a part of a wiring harness 80 illustrated schematically as a part of the warning circuit 82. The warning circuit 82 is illustrated as including a source of electrical energy such as battery 84 in series with ignition switch 86, which is electrically connected to conduit 74. The other portion of the circuit includes an indicator, such as lamp 88, connected in series with electrical conduit 76 and ground. It can be seen that with switch 86 closed the circuit is closed when contacts 70 and 72 are connected. The bridging contact 90 for contacts 70 and 72 is mounted on the upper end of a rod 92 which is reciprocably received in hub 66. Rod 92 extends through a guide 94, secured through an integral grommet 96 formed as a part of diaphragm seal 62, and downwardly into chamber section 50. A float 98 is secured to the lower end of rod 92 in a suitable manner. Float 98 floats in the fluid 100 contained in housing 26 so that its vertical location depends upon the level of the fluid contained in the reservoir section 50. So long as there is sufficient fluid in the reservoir, float 98 holds rod 92 upwardly and keeps bridging contact 90 out of electrical contact with contacts 70 and 72. When the level of the fluid 100 falls sufficiently below the normal level, as shown in FIG. 2, float 98 moves downwardly, moving rod 92 with it until bridging contact 90 engages contacts 70 and 72. This closes the switch 102 formed by contacts 70, 72 and 90. Assuming the ignition switch 86 is closed, this will cause the indicator lamp to be energized, indicating to the operator that the fluid level is sufficiently low to warrant attention.

The guide member 94 has vents 104 formed through it so that the switch chamber 68 in hub 66 is vented to the reservoir section 50. A vent slot 119 in the cover vents chamber 106 to atmosphere. This permits the diaphragm to move downwardly in the convoluted area 108 when the fluid level drops. This area is illustrated as being above reservoir chamber section 52.

The outer portion of diaphragm seal 62 is formed as a peripheral end wall 110. This wall has a section which extends upwardly and is provided with a series of outer lips 112 and inner lips 114. The wall then extends radially outwardly to provide a level flange section 116. If desired, notched seal retainers 118 may be provided which extend upwardly from flange 116 at several peripherally spaced locations. Four such locations are shown, two seal retainers being on each side of the cover assembly. In many instances end wall 110 will grip the cover sufficiently to hold the diaphragm seal in place, and no retainers 118 are needed.

The cover 60 has a channel 120 formed peripherally about its underside so that the channel opens downwardly. The channel is defined by a bottom surface 122, an inner side wall 124, and an outer side wall 126. Apertures 128 are provided in the channel bottom surface so that the seal retainers 118 extend therethrough and snap into position, retaining the seal 62 to the cover 60. If no retainers 118 are used, inner lips 114 grip channel wall 124 to hold the seal in place. The channel outer side wall 126 is provided with tabs 130, preferably located adjacent apertures 128, and having inwardly extending shoulders 132. These shoulders snap over the outer edge of flange 54. The seal flange 116 will lie against the housing upper edge surface 56. The cover assembly is therefore held in place on the reservoir housing. While this may provide some sealing action, it is not the primary means of sealing the reservoir cover to the reservoir housing. It can be seen that tabs 130 and shoulders 132 provide cover retainers which can be flexed to install and remove the cover assembly.

When the cover is installed over housing 26, it already has the seal lips 114 in engagement with the channel inner side wall 124. The inner surface 134 of housing 26 is engaged by lips 112 of the seal end wall 110, the lips being slightly deformed as they are pressed into position between the radially spaced surfaces of wall 124 and housing 26. This provides an effective seal without requiring all portions of the channel bottom surface 122 to be pressed tightly down against upper edge surface 56. This eliminates the requirement for a strong bail arrangement and permits the use of the cover retainer arrangement described above. Also, due to the large peripheral extent of seal end wall 110, as well as the flexibility of the lips 112 and 114, the tolerance requirements are less stringent.

Figure 3:
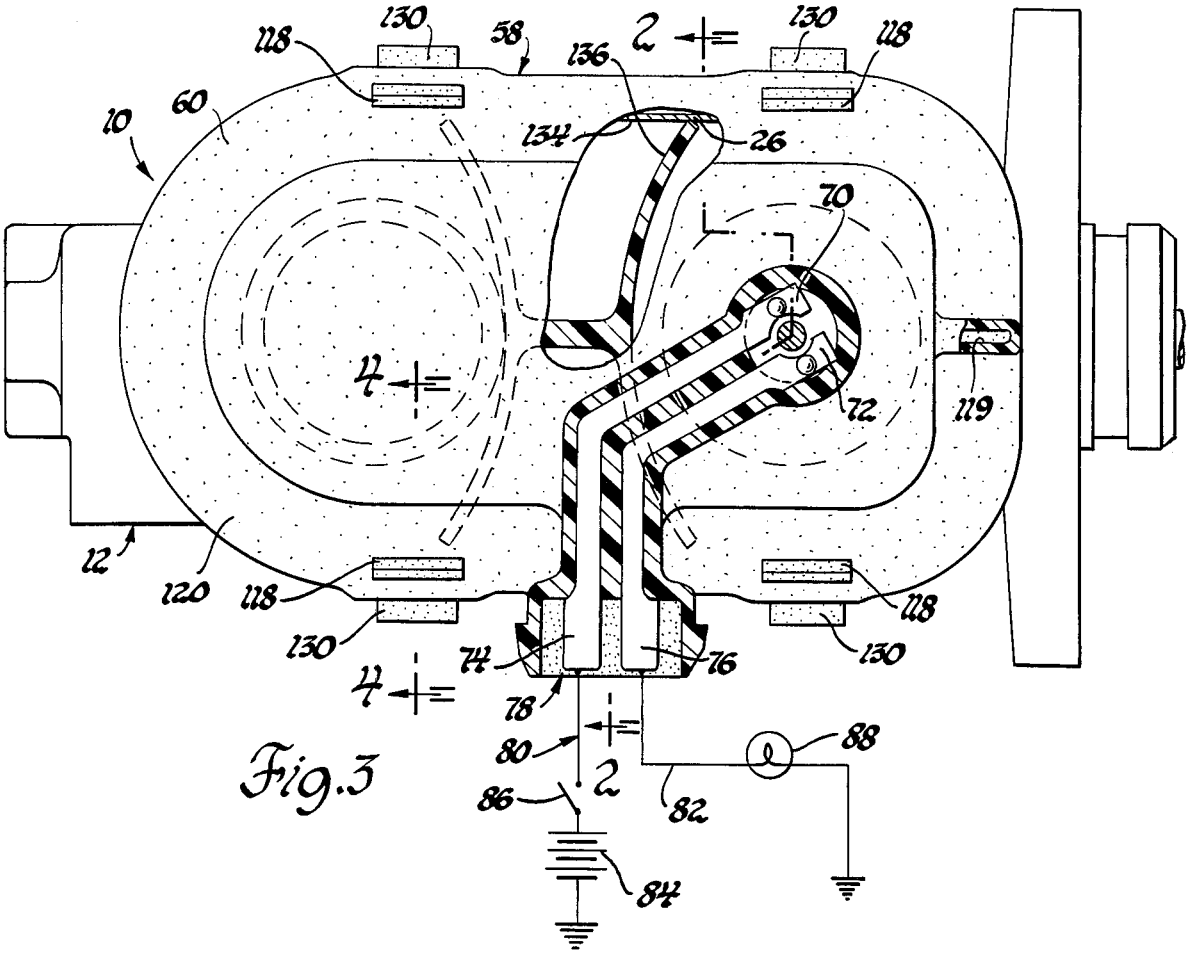
FIG. 3 is a plan view of the master cylinder taken in the direction of arrows 3—3 of FIG. 1, with parts broken away and in section, and including a schematic fluid level warning circuit.
Figure 4:
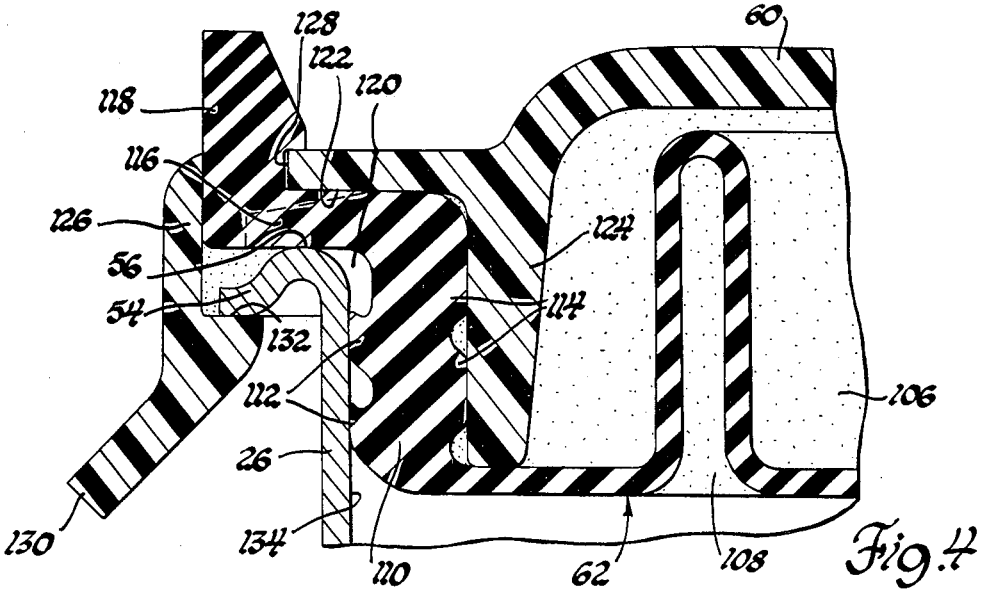
FIG. 4 is a fragmentary cross-section view taken in the direction of arrows 4—4 of FIG. 3.

The baffle 136 for the reservoir chamber is illustrated as being of a suitable plastic having a generally H-shaped cross-section shown in FIG. 3. The baffle legs have spring-like characteristics so that they may flex as they engage the inner side of housing 26. Thus the baffle is readily installed before the cover is in place, is retained in position, and effectively separates the housing into chamber sections 50 and 52. The baffle minimizes sloshing action of the fluid in the reservoir while permitting the fluid to move in a somewhat restrictive manner between chamber sections 50 and 52 so that the fluid level sensor mechanism senses the actual fluid level of the entire chamber.

What is claimed is:

1. For use with a fluid reservoir adapted to contain a fluid sealed from atmosphere and defining a fluid level adapted to be sensed without breaking the seal, the reservoir being defined by a housing having a continuous upper edge surface:

a combined reservoir cover and seal and fluid level sensor assembly comprising:

a molded cover having a channel on one side thereof defined by a bottom surface adapted to align with the reservoir housing upper edge surface and spaced inner and outer side walls adapted to receive the housing upper edge surface therebetween, a generally cylindrical sensor mounting hub adapted to be positioned over the reservoir when the edge surface is received in said channel above a portion of the reservoir where the fluid level is to be sensed, and electrical conduits leading from said hub within said cover to a connector integrally formed as a part of said cover and adapted to receive a wiring harness connecting the sensor to a signal circuit;

said sensor having switch means mounted in said hub in electrical communication with said electrical conduits and float means extending below the cover and supported by said hub, said float means being adapted to extend into the reservoir for floating with respect to the fluid level therein to close said switch means to energize the signal circuit when the fluid level decreases to a predetermined point;

and a seal comprising a convoluted diaphragm spaced from said cover to form a cavity therebetween, said seal having an end wall positioned in said channel with one side thereof in sealing engagement with said channel inner side wall and adapted with the opposite side thereof to sealingly engage the reservoir housing adjacent the upper edge surface thereof to seal contained fluid from atmosphere, said float means extending through an aperture in said diaphragm, a guide in said aperture having means for venting between the reservoir and the portion of said hub containing said switch means, and vent means venting said cavity to displace air therethrough in response to changes in said fluid level;

and means for removably retaining said cover and said seal on the reservoir.

2. A fluid reservoir assembly comprising:

a reservoir body having side wall means defining an open top and an inner wall surface extending vertically around the portion of said body immediately beneath said open top;

a cover assembly for closing said open top and including a cover body and a diaphragm seal, said cover body having a downwardly opening channel formed peripherally thereabout and defined by a bottom surface and spaced inner and outer side walls, siad diaphragm seal having a diaphragm section, a vertically extending end wall section formed peripherally around said diaphragm section, seal lips formed on said end wall section and extending peripherally inward and peripherally outward therefrom, the inwardly extending lips sealingly engaging said channel inner side wall so that said diaphragm seal defines with said cover body a cavity above said diaphragm seal, the outwardly extending lips sealingly engaging said reservoir body inner wall surface below said open top so that said diaphragm seal defines with said reservoir body a sealed fluid reservoir with the sealing action of said end wall lips being enhanced by a press fit of said lips between said channel inner wall and said reservoir body inner wall surface;

and vent means including a passage formed through said channel inner wall and opening adjacent said channel outer wall above the open top of said reservoir body, said channel outer wall being peripherally spaced outwardly from said reservoir body side wall means, said vent means venting said cavity to atmosphere.

3. A fluid reservoir assembly comprising:

a reservoir body having side wall means defining an open top and an inner wall surface extending vertically around the portion of said body immediately beneath said open top;

a cover assembly for closing said open top and including a cover body and a diaphragm seal forming a cavity therebetween, said cover body having a downwardly opening channel formed peripherally thereabout and defined by a bottom surface and spaced inner and outer side walls, said diaphragm seal having a diaphragm section and a vertically extending end wall section formed peripherally around said diaphragm section, at least one peripheral side of said end wall section having peripherally extending seal lip means formed thereon, said end wall section sealingly engaging said channel inner side wall and said reservoir body inner wall surface below said open top so that said diaphragm seal defines with said reservoir body a sealed fluid reservoir with the sealing action of said end wall lip means being enhanced by a press fit of said end wall section including said lip means between said channel inner wall and said reservoir body inner wall surface;

and vent means opening adjacent said channel outer wall above the open top of said reservoir body, said channel outer wall being peripherally spaced outwardly from said reservoir body side wall means, said vent means venting said cavity to atmosphere.

* * * * *